United States Patent [19]

Knapp

[11] Patent Number: 4,836,539

[45] Date of Patent: Jun. 6, 1989

[54] AIMING APPARATUS FOR USE IN THE GAME OF BASKETBALL

[76] Inventor: Daniel K. Knapp, 9930-4 Sepulveda Blvd., Mission Hills, Calif. 91345

[21] Appl. No.: 172,809

[22] Filed: Mar. 28, 1988

[51] Int. Cl.[4] ..... A63B 63/08; A63B 69/00

[52] U.S. Cl. ..... 273/1.5 A

[58] Field of Search ..... 273/1.5 A, 1.5 R

[56] References Cited

U.S. PATENT DOCUMENTS

| | | | |
|---|---|---|---|
| 2,039,794 | 5/1936 | Hayden | 273/1.5 A |
| 3,160,414 | 12/1964 | Gray | 273/1.5 A |
| 3,814,421 | 6/1974 | Spier, Jr. | 273/1.5 A |
| 3,945,638 | 3/1976 | Luebkeman | 273/1.5 A |
| 4,213,606 | 7/1980 | Wilson | 273/1.5 A |
| 4,226,416 | 10/1980 | Callanan | 273/1.5 A |
| 4,244,569 | 1/1981 | Wong | 273/1.5 A |
| 4,506,886 | 3/1985 | Lamb, Sr. | 273/1.5 A |
| 4,706,954 | 11/1987 | Kershew | 273/1.5 A |
| 4,720,101 | 1/1988 | Farkas, Jr, | 273/1.5 A |

*Primary Examiner*—Paul E. Shapiro
*Attorney, Agent, or Firm*—Roger A. Marrs

[57] ABSTRACT

An aiming apparatus having a conical open-ended, outwardly flaring target supported on and coaxial with the rim projecting from a backboard. The target includes a flared top end marked with a series of visual target markers along its peripheral edge and a circular band indicative of rim location immediately beneath the markers. A concave circuar lip and spaced-apart brackets are integrally carried on the inside of the flared open end for mounting and stabilizing on the rim, and an outwardly extending shoulder is integrally carried on the bottom end of the target for supporting a supplemental aiming indicator and rebounder device, including a support ring mounting a vertical pointer terminating adjacent to the series of target markers and an arcuate chute downwardly depending below the target from the support ring.

3 Claims, 2 Drawing Sheets

AIMING APPARATUS FOR USE IN THE GAME OF BASKETBALL

BACKGROUND OF THE INVENTION

1. Field of the Invention

The present invention relates to the field of basketball and more particularly to a novel apparatus useful in improving accuracy and performance by a player in tossing a basketball through a standard basket rim and net affixed to a standard basketball backboard.

2. Brief Description of the Prior Art

In the playing of the game of basketball, it is understood that a basketball rim is, in effect, only a small portion of the actual target area that can be utilized by a player for visually aiming the basketball preparatory to tossing the ball at the rim. The rim provides very little in the way of visual aid and promotes little in confidence in relation to effectiveness and accuracy in shooting or tossing of the basketball. Moreover, not only does the rim offer a misleading and inhibitively small visual representation of the true dimensions of the target at which the player is shooting, but reinforces what in effect is an optical illusion suggesting that the target being aimed for is much smaller than it actually is. The greater the distance from the basket rim, the greater the effect of the optical illusion.

Although some attempts have been made to provide aiming devices for improving the effectiveness and accuracy in tossing of the basketball through the rim, most of these prior attempts have encountered difficulties which stem largely from the fact that no provision has been made to overcome the adverse effects of the optical illusion. Although a variety of nets, bull's-eye targets on the backboard, independent markers and indicators have been used, such prior attempts are generally expensive, time-consuming to install and are generally confusing to the players in practice.

Therefore, a long standing need has existed to provide a novel apparatus, method and concept which will improve player accuracy anf performance in "shooting" a basketball by providing an aiming aid presenting a true representation of the usable and effective area leading into a basketball rim and net. Such a device should influence a player to aim and shoot properly with the most productive trajectory, arc and technique whereby further enhancement of effectiveness and improvement in accuracy is provided.

SUMMARY OF THE INVENTION

Accordingly, the above problems and difficulties are obviated by the present invention, which provides a novel aiming device promoting accuracy and efficiency in the tossing of a basketball through a rim and net basket, and which comprises an open-ended cone carried on the conventional rim of a standard basket net and backboard and which downwardly dependes therefrom so thar a tossed ball may enter at the top end of the cone member and drop through and out of the bottom thereof. The top of the member includes a flared lip having a plurality of evenly spaced-apart markers disposed on the exterior thereof immediately above a band which represents the location of the supporting rim itself. The lower or bottom end of the conical member includes an outwardly projecting shoulder adapted to support a supplementary aiming indicator and rebounder combination which cooperates with the series of markers, assisting the player in visual aiming as well as cooperating with the exit end of the member for deploying the basketball back towards the player.

In another form of the invention, the conical member may take the form of an indicator ring mounted on the rim with the plurality of markers and an actual rim band, and which further includes a multiplicity of downwardly depending flexible strips thrrrough which the basketball will travel after an accurate toss.

Therefore, it is among the primary objects of the present invention to provide a novel visual aid granting a basketball player greater awareness of what he is actually aiming at, and, in the process, promoting confidence as well as improving shooting techniques.

It is another object of the present invention to provide a novel basketball aiming device that may be readily mounted on a standard bsaketball basket that outwardly projects from the face of a backboard, and which will utilize the aiming and shooting method of reversing the negative optical illusion inherent in a standard basketball basket as it applies to the improvement of shooting accuracy in the game of bsaketball.

Another object of the present invention is to provide a novel visual aid, of assistance to a basketball player in the tossing of a basketball towards a basket, which gives the player a greater awareness of what he is actually shooting at and which will increase his confidence as well as force the player to execute the most effective shooting techniques.

Yet a further object of the present invention is to provide an apparatus, concept and method with which basketball players can improve the accuracy of their shooting and incresae individual shooter confidence by utilizing beneficial visual representation means of a larger, undefined and unrepresented but actual target, which is, in effect, negatively and inhibitively represented by the rim and the net of a basket, and which restricts a player's ability to increase efficiency and, therefore, accuracy of shooting.

Still a further object of the present invention is to provide a novel visual aiming device for use with a conventional basketball basket, forcing the player-shooter, through the phisical barrier of a flared upper mouth of the inventive apparatus, to execute a higher and, therefore, more efficient and accurate arc on each toss.

A further object of the present invention is to provide spaced aiming marrkers and a cooperating aiming indicator, in combination with a rebounding system, that aid a player-shooter to line up and center the plane of his toss or shot.

A further object of the present invention is to provide an automatic rebounding means and method, in combination with an aiming system, for augmenting the rebounding and retrieval of a basketball, which saves time and effort on the part of the player and renders said saved time available fro additional practice.

BRIEF DESCRIPTION OF THE DRAWINGS

The features of the present invention which are believed to be novel are set forth with particularity in the appended claims. The present invention, both as to its organization and manner of operation, together with further objects and advavtages thereof, may best be understood with reference to the following description, taken in connection with the accompanying drawings in which:

DESCRIPTION OF THE PREFERRED EMBODIMENT

Figure 1:
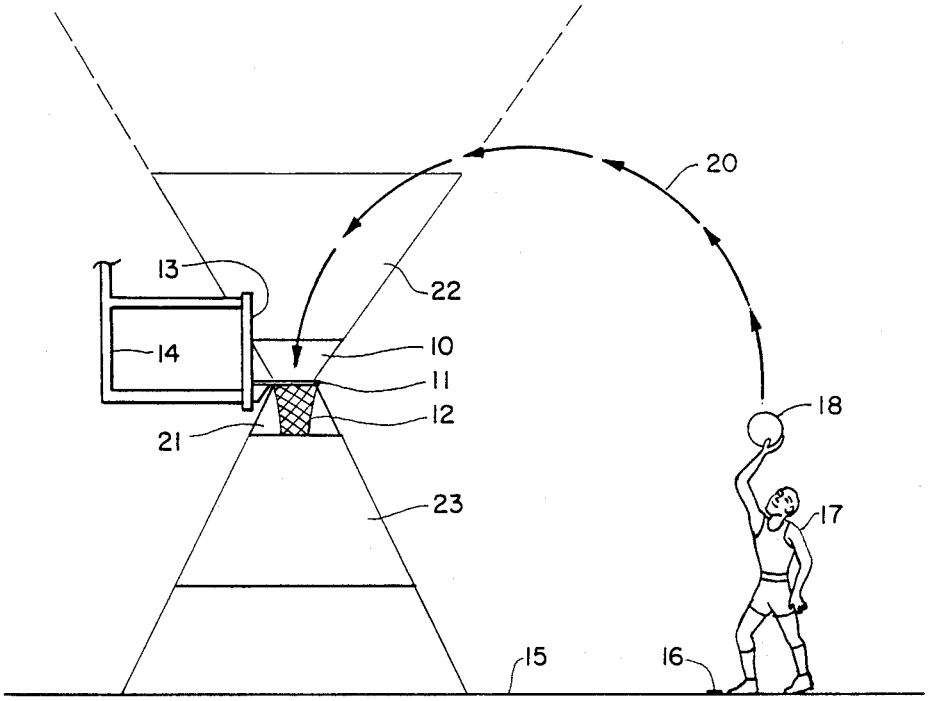
FIG. 1 is a diagrammatic illustration showing the principle of negative illusion utilized in accordance with the present invention.

Referring to FIG. 1, a diagrammatic illustration is shown of the unrepresented actual target area which can effectively receive a basketball tossed by a player during a practice session as opposed to the much smaller representation of that target represented by the rim. The unrepresented actual target area is indicated by numeral 10 while the rim is illustrated by numeral 11 from which a standard net 12 downwardly depends. The rim outwardly projects from the front face of a backboard 13 which is held in proper position over a basketball court by means of a frame 14. The playing court surface is indicated by numeral 15 and a foul line is indicated by numeral 16. As illustrated, the player 17 is in the process of tossing a basketball 18 towards the basket rim 11 so that the ball will travel a particular arc or trajectory as indicated by numeral 20. At the distance away from the rim, the rim opening without the present invention appears much smaller to the player than when the present invention is attached to the rim so as to downwardly depend therefrom about the net 12. An area 21, representing the area about which the present invention surrounds the net 12, is illustrated, and it can be seen that this area is coaxially disposed with respect to the upper actual target area 10. The mouth of the actual target area is substantially larger in a visual sense from that of the opening through the rim 11 so that the player is presented with a truer visual indicator when taking aim preparatory to shooting the basketball 18 towards the basket. Not only does the rim 11 offer a misleading and inhibitively small visual representation of the true dimensions of the actual effective target at which the player is aiming, the net beneath it, slanting inwardly to a point directly below the center of the rim, further reinforces an optical illusion effect that the target is much smaller than it actually is. The greater the distance from the basket, the greater the effect of this optical illusion.

By employing the present invention simulated by areas 10 and 21, the adverse effects noted above are obviated and the invention specifically reverses that negative optical illusion to a degree that is both feasible, not misleading and which is beneficial to players desiring to improve the accuracy of their aim and shooting. By the construction of the invention, the apparatus in all its versions and forms forces a player to aim and shoot properly whereby the most productive arc or trajectory, plane and technique of toss are experienced. Thereby, the invention provides further enhancement of effectiveness and improvement in aiming and shooting accuracy.

Referring further to FIG. 1, area 22 may be referred to as an extended target area above the actual target area 10 while the area 23 may be considered an area through which the basketball will drop or rebound from the basket once it has passed through the net 12.

Figure 2:
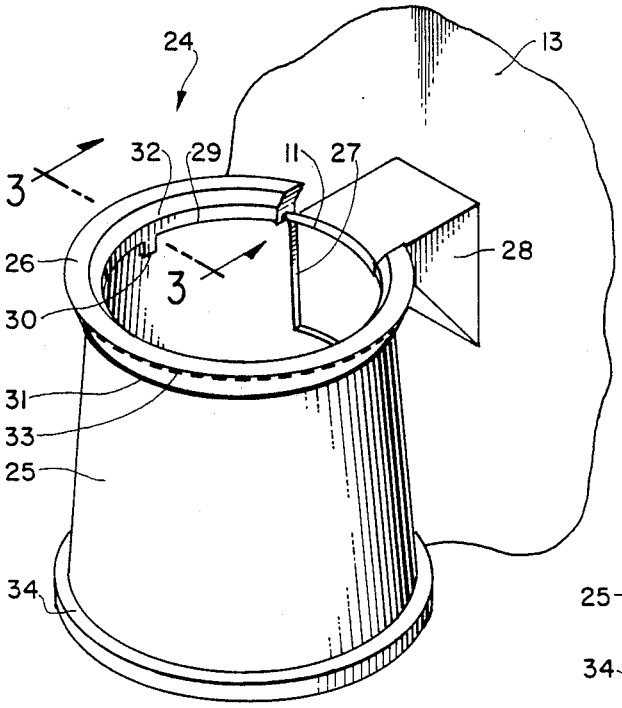
FIG. 2 is an enlarged perspective view showing the novel open-ended outwardly flaring conical aiming device used in the inventive method of FIG. 1.

Referring now in detail to FIG. 2, the apparatus of the present invention is indicated in the general direction of arrow 24 which includes an open-ended, outwardly flaring conical body 25 shape terminating at its top end in an also outwardly projecting flange 26. The body 25, as well as the flange 26, is provided with cutout 27 effective to permit and accommodate the rim 11 mounting bracket 28 which outwardly projects from the face of the backboard 13. A plurality of spaced-apart brackets, such as represented by numeral 30, and a concave circular lip, such as represented by numeral 29, are integrally formed on the interior of the body or member 25 immediately adjacent to the inside of the flange 26 so as to insertably receive the rim 11. For player assistance, a darkened band 31 extends about the exterior of the member 25 representing the location of rim 11. The flange 26 flares upwardly from the band indication 31 and the flared flange further includes an inwardly tapering surface 32 for directing the basketball through the member or body 25.

It is also to be noted in FIG. 2 that a plurality of spaced-apart markers, such as marker 33, are provided along the extreme exterior edge of the flange 26, which markers will assist the plyer in aiming and centering preparatory to shooting the ball at the rim 11 and the inventive member of body 25. The extreme bottom of the body or member 25 is provided with an annular shoulder 34 which outwardly projects to stiffen and reinforce the member. Preferably, the member is composed of a suitable material, such as plastic or the like, and may be colored in a vivid shade or hue and, if desired, alpha/numeric message information or graphic representations can be placed on the outside of the member.

Figure 3:
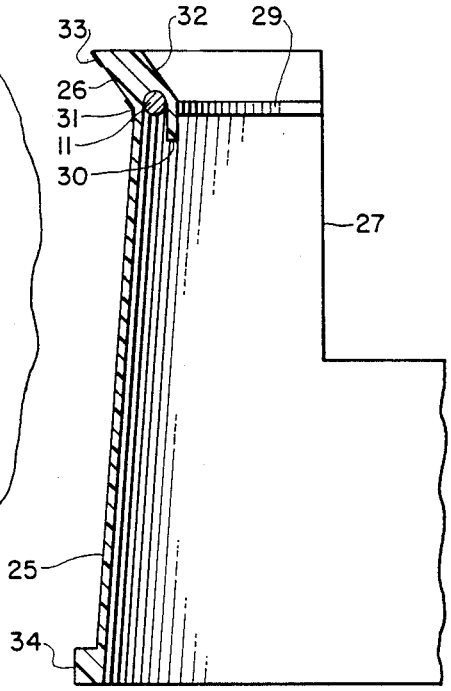
FIG. 3 is an enlarged sectional view taken in the direction of arrows 3-3 of FIG. 2.

Referring now in detail to FIG. 3, it can be seen that the body or member 25 is tapered from the top towards the bottom and that the flange 26 outwardly projects in flared fashion so that the overall configuration may be termed as being frustro-conical in side elevation. The plurality of integral brackets 30 and concave circular lip 29 insertably receive the rim 11 so that member or body 25 is supported thereon and is coaxial therewith.

Figure 4:
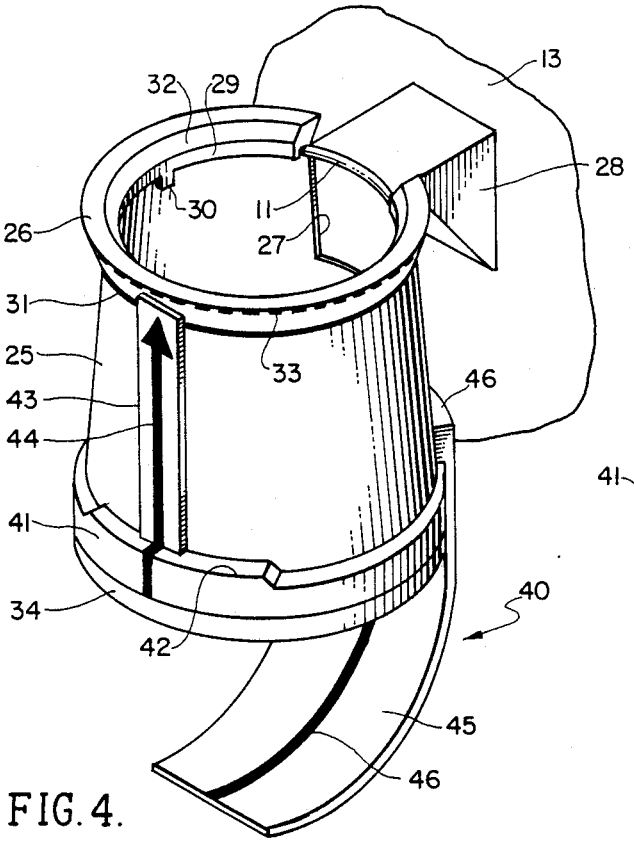
FIG. 4 is a perspective view of the novel open-ended outwardly flaring conical aiming device shown in FIG. 2 and further incorporating an aiming indicator and automatic rebounding means.

Referring to FIG. 4, the novel basketball target device of the present invention is furhter illustrated with the addition of an aiming indicator and a basketball rebounding device which is generally illustrated in the direction of arrow 40. This latter device is illustrated as having been placed over the body or member 25 and positioned to rest on the shoulder 34. The device includes a circular band 41 which rests on the top of the shoulder 34 and includes a thickened portion 42 that supports an upwardly mounted panel 43 which displays an arrow indicator 44. The arrow indicator is intended to be used in cooperation with individual and selected ones of the plurality of markers 33 carried on the exterior of the flared flange 26. Therefore, the indicator 44 may be moved to a desired position with respect to the markers by slidably revolving the ring 41 on the shoulder 34 until the desired alignment between the indicator and the markers has been achieved.

Additionally, the device 40 includes a rebounder comprising a curved panel 45 which downwardly depends from the band 41 and terminates substantially beneath the body or member 25. For visual alignment, the panel 45 includes a central marker or indicator 46 that is in alignment with the indicator 44.

Figure 5:
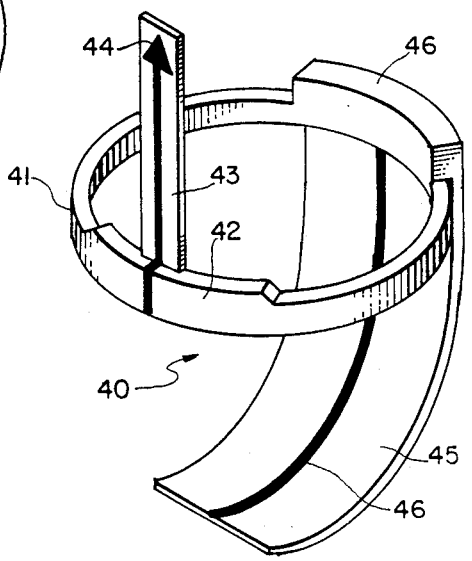
FIG. 5 is a perspective view of the aiming indicator and automatic rebounder used on the basket member shown in FIG. 4.

Referring now to FIG. 5, the indicator and rebounder 40 is illustrated wherein it can be seen that the ring 41 is substantially thickened at portion 42 so as to support the panel 43 and that the opposite side of the ring is substantially thickened as indicated by member 46 so as to support the downwardly depending arcuate panel 45. The panel 45 serves to interfere with the downward travel of the ball after it has left the rim or net through which it has been tossed and the curve of the panel will redirect the ball outwardly away from the basket and back to the player-shooter. Depending on where the indicator 43 has been aligned with respect to the selected marker 33, the rebound direction of the ball will follow alignment of the curved panel 45.

Figure 6:
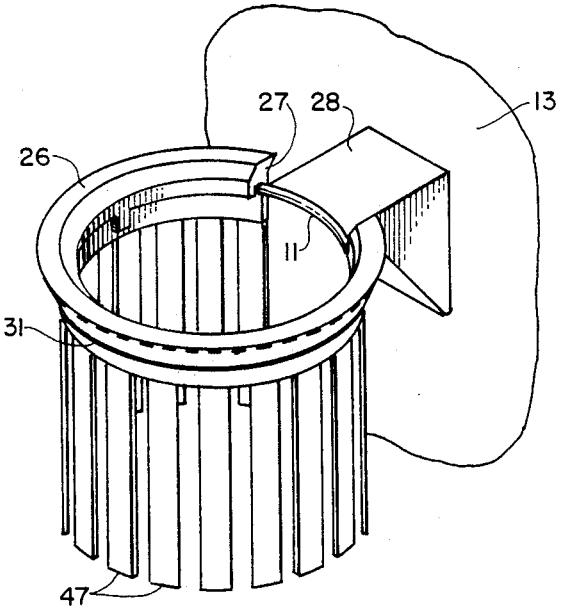
FIG. 6 is a perspective view of another version of the present invention.

Referring now in detail to FIG. 6, another version of the invention is illustrated wherein the body of the apparatus is repalced with a plurality of strips of flexible material. A typical strip is indicated by numeral 74. The strips are attached at one end of the underside of the flange portion of the apparatus substantially about where the ban 31 is located and the strips downwardly hang in an unsupported manner.

Figure 7:
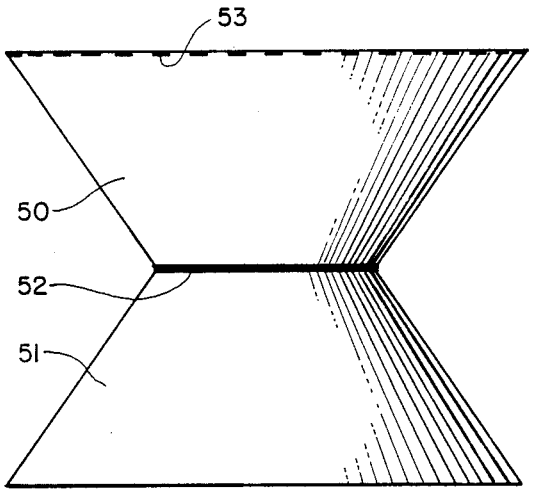
FIG. 7 is a perspective view showing still another version useful for children.

Referring in detail to FIG. 7, another embodiment of the invention is illustrated wherein the shape of the device is that of an hourglass having an upper section 50 and a lower section 51 which are integrally joined together at their opposing ends and at which juncture, a band 52 is placed in order to indicate the position of the rim 11. The exposed top of the upper section 50 is provided with the plurality of indicators 53 in the same fashion as the indicators 33 previously described. Such a device may be readily used by children or less sophisticated players for practicing basketball shooting.

The inventive concept and apparatus of the present invention is employed by attaching the apparatus to a common basketball rim 11 through the use of the accommodating rear cutout or opening 27 in the body or member 25. The plurallity of brackets 30 fit over the rim so as to support the apparatus. Further support on the rim is achieved by the shape of the interior of the cylinder at the point where it coincides with the flared flange 26 so that the shaping creates an upward and inward rising and reverse-matching circular concave lip 29, a portion of the flared flange 32 that, along with the brackets, rest on the top of the basketball rim. By being so affixed to the rim, the optically colored plastic member 25 presents a feasible, practical and more truly representative opening for the player to aim at so as to be more accurate and have greater practicability in the practice of aiming and shooting the basketball.

In a secondary sense, the flared flange or mouth feature of the present invention creates a barrier to the player that forces him to execute his shots with a higher and more efficient and effective arc so that accuracy and shooting percentage are improved. The darkened rim indicator or band 31 incorporated onto the body or member 26 shows the player the precise location of the actual but hidden rim inside the member. The higher and second imaginary rim over which the player must shoot and the arc the ball must take for maximum efficiency is more easily determined by the player so that his accuracy is improved.

In the advance version of the present invention, the additional augmenting indicator and rebounder element provides the shooter with additional visual aids to improve his shooting technique. This includes an indicator arrow 44 that provides the player with a highly visible reference to the exact point on the upper "imaginary rim" band of markers 33 over which a shot should be aimed for maximum efficiency. The indicator 44 is also used in combination with a separate but visually contiguous extension of its marker shaft on the rebounding panel 45 to combine with the two rim bands at the top of the apparatus so as to serve as a sighting and aiming aid. The automatic rebounding arm or panel 45 operates by trapping the ball in its downward path and sending it back to the player, allowing him to remain in one place for repeated and highly effective practice. The device also eliminates the time and effort involved in manual rebounding so that more time is available to the shooter or player for a greater amount of practice within the same time period and with the same or less expenditure of effort.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A basketball aiming apparatus mountable on a basket rim for use in practice, comprising the combination of:

an open-ended conical member having a top end and a bottom end disposed between a vertical passageway gradually tapering downwardly and outwardly from said top end to said bottom end for conducting the travel of a basketball therethrough;

said member top end having a continuous and unbroken outwardly flared flange including a tapered inner surface leading into said passageway;

means carried on the interior of said member within said passageway for releasably supporting and stabilizing said member on the basket rim;

said conical member includes a plurality of exposed visual target markers carried along the external peripheral edge of said flared flange;

an exposed visual circular band disposed on the external surface of said conical member indicative of the basket rim location; and said flared flange having an outer diameter substantially equal to the outer diameter of said member bottom end.

2. The invention as defined in claim 1 including:

an outwardly extending annular shoulder carried on said bottom end of said conical member; and a supplemental aiming indicator and rebounder device movably mounted on said annilar shoulder and having an arcuate chute downwardly projecting under said bottom end beneath said vertical passageway so as to redirect the travel of a basketball upon therefrom.

3. The invention as defined in claim 2 including:

said aiming indicator and rebounder device further having a vertical terminating immediately adjacent to said target markers cooperating with said chute to assist a player in aiming.

* * * * *